US008684727B2

(12) United States Patent
Jonville et al.

(10) Patent No.: US 8,684,727 B2
(45) Date of Patent: Apr. 1, 2014

(54) RING FURNACE INCLUDING BAKING PITS WITH A LARGE HORIZONTAL ASPECT RATIO AND METHOD OF BAKING CARBONACEOUS ARTICLES THEREIN

(75) Inventors: Christian Jonville, Corenc (FR); Pierre-Jean Roy, Bilieu (FR); Yannick Drouet, Beaucroissant (FR)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 1149 days.

(21) Appl. No.: 12/599,607

(22) PCT Filed: Apr. 29, 2008

(86) PCT No.: PCT/EP2008/003448
§ 371 (c)(1),
(2), (4) Date: Nov. 10, 2009

(87) PCT Pub. No.: WO2008/138481
PCT Pub. Date: Nov. 20, 2008

(65) Prior Publication Data

US 2010/0209863 A1 Aug. 19, 2010

(30) Foreign Application Priority Data

May 14, 2007 (EP) ..... 07356065

(51) Int. Cl.
*F27B 7/30* (2006.01)

(52) U.S. Cl.
USPC ..... 432/192

(58) Field of Classification Search
USPC ..... 432/192
See application file for complete search history.

(56) References Cited

U.S. PATENT DOCUMENTS

| | | | | | |
|---|---|---|---|---|---|
| 1,330,164 | A | * | 2/1920 | Broadwell | 432/169 |
| 4,040,778 | A | * | 8/1977 | Black | 432/192 |
| 4,059,885 | A | | 11/1977 | Oldengott | |
| 4,253,823 | A | * | 3/1981 | Holdner | 432/18 |
| 4,552,530 | A | * | 11/1985 | Gunnes et al. | 432/192 |
| 5,466,150 | A | * | 11/1995 | Albersdorfer et al. | 432/192 |
| 5,473,628 | A | * | 12/1995 | Tokvam et al. | 373/110 |

(Continued)

FOREIGN PATENT DOCUMENTS

| | | |
|---|---|---|
| DE | 592117 C | 2/1934 |
| RU | 2157959 | 10/2000 |

(Continued)

OTHER PUBLICATIONS

International Search Report dated Jul. 9, 2008 (PCT/EP2008/003448); ISA/EP.

*Primary Examiner* — Gregory A Wilson
(74) *Attorney, Agent, or Firm* — Banner & Witcoff, Ltd.

(57) ABSTRACT

The invention relates to a ring furnace (1) having a longitudinal axis and comprising elongated bays (10), a plurality of hollow partitions (3, 3') arranged within the casing of each bay so as to be parallel to the longitudinal axis, a first end transverse wall (41) located at a first end of each bay (10), a second end transverse wall (42) located at a second end of each bay (10) and possibly one or more intermediate transverse walls (43) located between the first and second ends. The hollow partitions and transverse walls define baking pits (2) within the bays (10) for stacking carbonaceous articles therein. The baking pits have a length Lp and a width Wp, said length Lp being at least 15 times greater than said width Wp.

24 Claims, 10 Drawing Sheets

(56) References Cited

U.S. PATENT DOCUMENTS

| | | | | |
|---|---|---|---|---|
| 5,683,631 | A * | 11/1997 | Zabreznik | 264/105 |
| 6,339,729 | B1 * | 1/2002 | Dreyer et al. | 700/209 |
| 7,192,271 | B2 * | 3/2007 | Dreyer et al. | 432/192 |
| 8,069,628 | B2 * | 12/2011 | Jonville et al. | 52/506.02 |

FOREIGN PATENT DOCUMENTS

| | | |
|---|---|---|
| RU | 2206032 | 6/2003 |
| SU | 939912 | 8/1977 |
| WO | WO2007006962 A | 1/2007 |

* cited by examiner (B)

(A)

RING FURNACE INCLUDING BAKING PITS WITH A LARGE HORIZONTAL ASPECT RATIO AND METHOD OF BAKING CARBONACEOUS ARTICLES THEREIN

CROSS-REFERENCE TO RELATED APPLICATIONS

The present application is a U.S. National Phase application based on International Application No. PCT/EP2008/003448, filed Apr. 29, 2008, and designating the United States of America, which claims priority to European Patent Application No. 07356065.8, filed May 14, 2007, and claims priority to and the benefit of all the above-identified applications, which are incorporated by reference herein in their entireties.

FIELD OF THE INVENTION

The invention relates to ring furnaces for baking carbonaceous articles, especially open type ring furnaces. The invention relates more specifically to the internal structure of ring furnaces and methods of baking carbonaceous articles.

BACKGROUND ART

Open type ring furnaces are well known. British application GB 2,129,918 and U.S. Pat. Nos. 5,683,631 and 6,339,729 describe such ring furnaces.

Open type ring furnaces comprise series of baking pits that are delimited by hollow partitions, often called flue walls, and transverse walls. The partitions and walls are made of refractory bricks, such as those described in International Applications Nos. WO 95/22666 and WO 97/35150.

The baking pits are designed to receive green carbonaceous articles and packing material therein during the baking operations. The hollow partitions are intended for the circulation of heating flue and cooling gas during the baking operations. The transverse walls partition the furnace into a plurality of separate firing sections.

Groups of successive sections are simultaneously utilized to make up a baking sequence for a batch of carbonaceous articles. For that purpose, heating equipment is installed at a specific location of groups of sections while exhaust equipment is installed downstream of the heating means and blowing equipment is installed upstream of the same. After completion of a firing operation, all pieces of equipment are shifted downstream by a specified number of sections.

The applicants addressed the issue of finding ring furnaces that are more economical to make and operate than the known ring furnaces.

BRIEF SUMMARY OF THE INVENTION

A first object of the invention is a ring furnace having a longitudinal axis X-X' and comprising a first elongated bay and a second elongated bay, each bay being parallel to said axis and including a casing, a plurality of hollow partitions arranged within said casing of each bay so as to be parallel to said axis, a first end transverse wall located at a first end of each bay, a second end transverse wall located at a second end of each bay and possibly one or more intermediate transverse walls located between said first and second ends, said transverse walls being arranged so as to be perpendicular to said axis, said hollow partitions and transverse walls defining baking pits within said bays for stacking carbonaceous articles therein, said baking pits having a length Lp and a width Wp, said length Lp being at least 15 times greater than said width Wp.

Said ring furnace thereby comprises baking pits with a large horizontal aspect ratio Lp/Wp.

The inventors noted that for industrial furnaces the brickwork amounted to a significant item for the cost of production of carbonaceous articles and that the operating costs could be reduced by reducing the number of transverse walls. A furnace according to the invention makes it possible to reduce the number of transverse walls and the required brickwork compared to known ring furnaces.

The inventors further noted that it was possible to operate a ring furnace according to the invention without unacceptable collapse or deformation of the hollow partitions.

The large horizontal aspect ratio Lp/Wp of the baking pits makes it possible to more finely adjust the baking process since the creeping step or "pitch" of the baking process, i.e., the distance between two successive positions of an exhaust ramp, is not necessarily the same as the length of a loading and unloading step (Pa).

Another object of the invention is a method of baking carbonaceous articles including providing a ring furnace according to the invention, stacking said carbonaceous articles in at least one baking pit of said furnace so as to form at least one stacking arrangement having a length La, a first end and a second end, adding packing material around said stacking arrangement so as to protect said articles during said baking, providing at least one heating ramp, an exhaust ramp, a blowing ramp and, optionally, a cooling ramp, and firing a specific part of said arrangement using said heating ramp.

According to an advantageous embodiment of the invention, said method further includes providing at least one removable strut comprising a support member, such as a bar, and at least one spacer and positioning said removable strut on said furnace so that said spacer is inserted in one of said baking pits. Preferably, said removable strut is positioned in a zone of said baking pit that contains no carbonaceous article.

Said removable strut typically comprises a plurality of spacers evenly distributed on said support member so that said spacers can be inserted in adjacent baking pits.

Said removable strut further strengthens said hollow partitions.

Said ring furnace and methods of operating the same are particularly intended for the baking of carbonaceous anodes designed for use in electrolysis cells intended for the production of aluminium through the Hall-Héroult process.

BRIEF DESCRIPTION OF THE DRAWINGS

The invention is described in detail below with reference to the appended figures wherein.

DETAILED DESCRIPTION OF THE INVENTION

Figure 1:
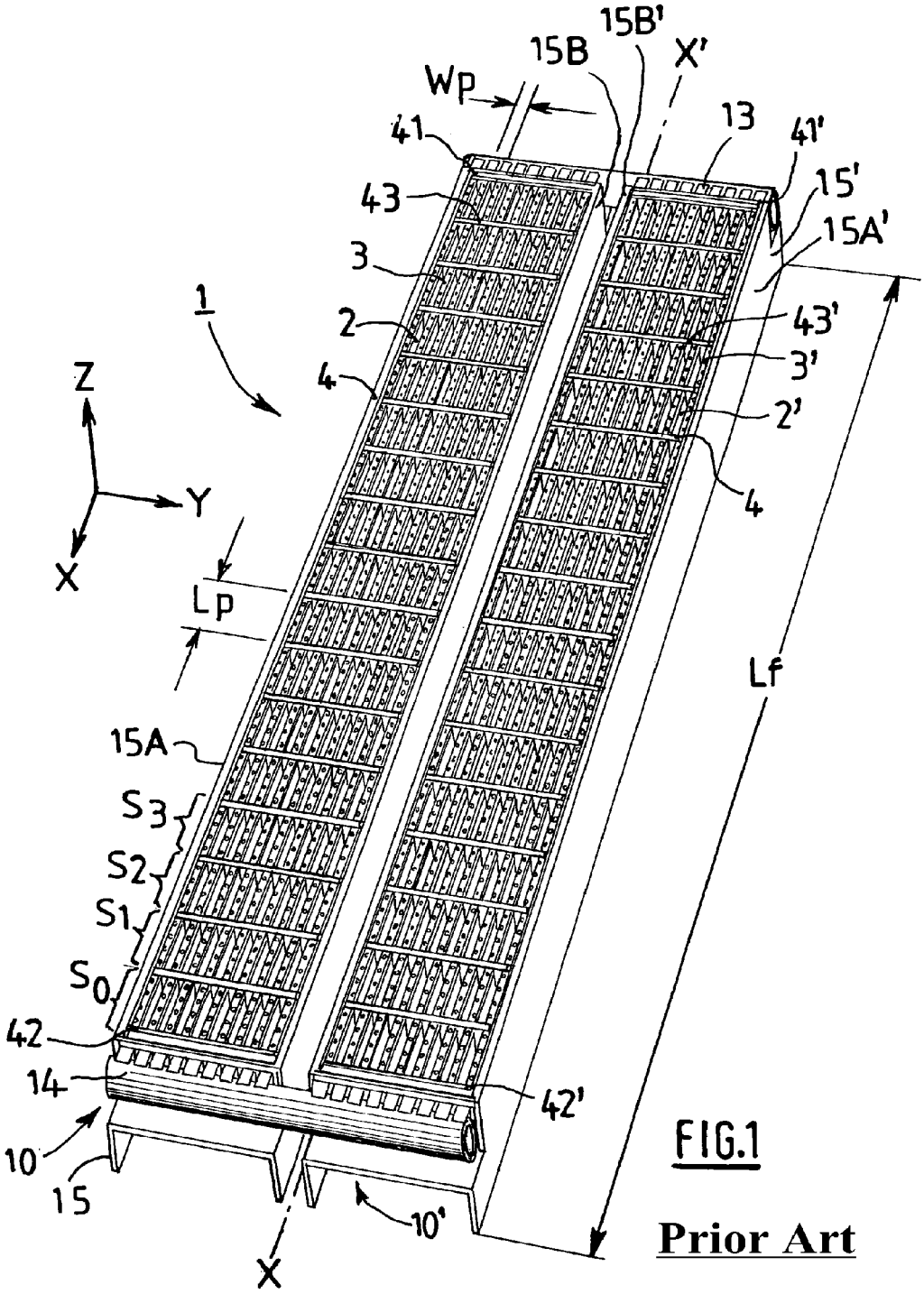
FIG.1 Prior Art
FIG. 1 illustrates a perspective view of an open ring furnace according to prior art.
Figure 2:
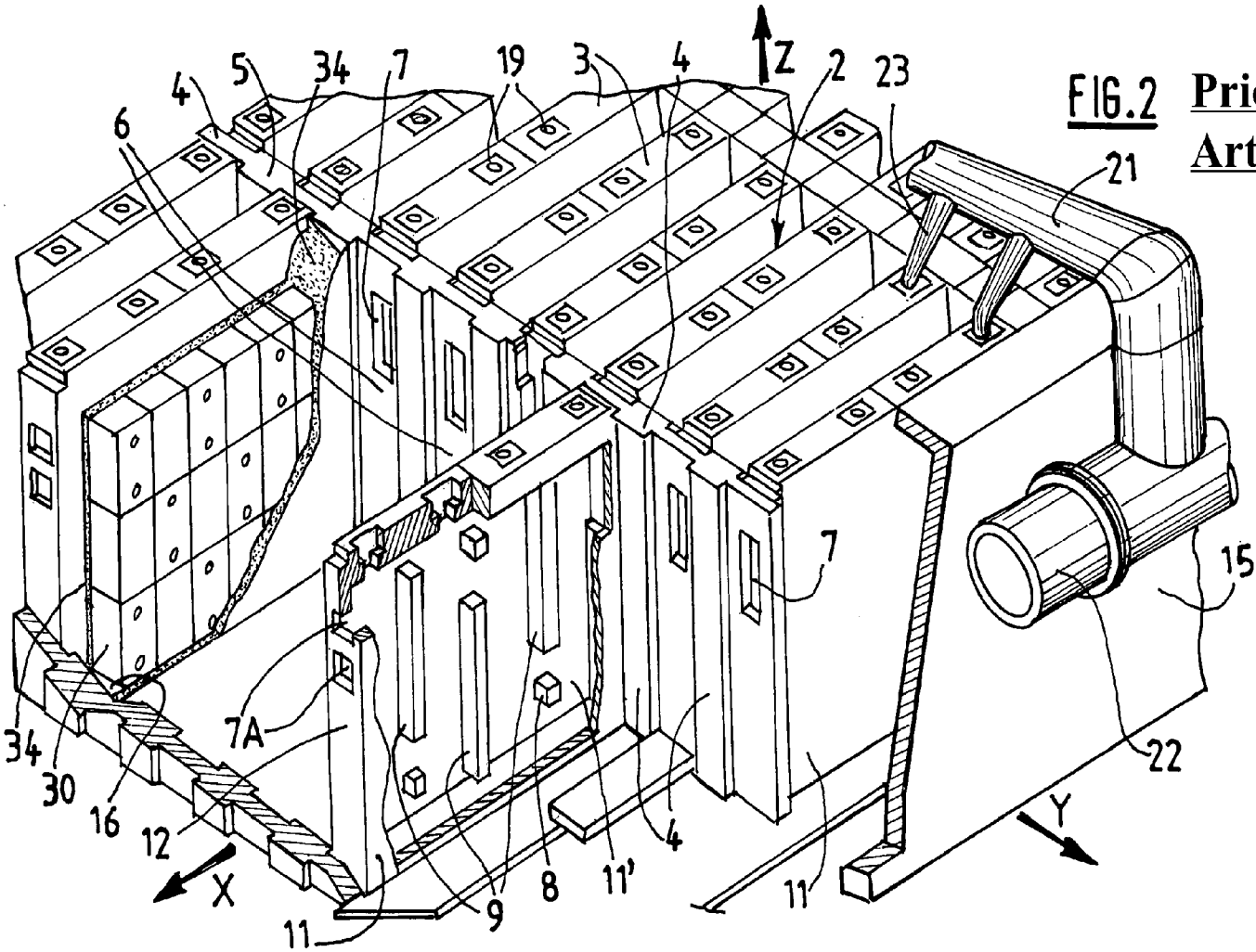
FIG.2 Prior Art
FIG. 2 illustrates a perspective view, partially exploded, of an open ring furnace according to prior art.

As illustrated in FIGS. 1 and 2, an open type ring furnace (1) usually comprises two parallel bays (10, 10') that are typically symmetrically arranged with respect to a longitudinal axis X-X' (X-axis). Said bays are generally circumscribed by a casing (15, 15'), which is typically made of concrete. Said bays have a length Lf that is typically between 50 and 100 meters and that may now reach and possibly exceed 150 meters.

Said bays (10, 10') include external lateral partitions (15A, 15A', 15B, 15B') and a plurality of inner partitions (3, 3', 4, 4') that form series of baking pits (2, 2') having an elongated shape parallel to said longitudinal axis. Said baking pits (2, 2') have a length Lp in the longitudinal direction and a width Wp in the transverse direction.

Refractory lining is usually provided within said casing (15, 15') at the bottom and on the sides thereof.

Each of said bays (10, 10') includes a first end transverse wall (41, 41') at one end and a second end transverse wall (42, 42') at an opposite end and, usually, a plurality of intermediate transverse walls (43, 43') evenly distributed between said end transverse walls (41, 41', 42, 42'). Said transverse walls (41, 41', 42, 42', 43, 43') partition said bays (10, 10') into series of distinct sections (So, S1, S2, S3, . . . ).

Said baking pits (2, 2') are delimited by hollow partitions (3, 3'), said transverse walls (41, 41', 42, 42', 43, 43')—more particularly the pillars (5) thereof—and a floor (16). Said hollow partitions (3, 3') and transverse walls (41, 41', 42, 42', 43, 43') form the substantially vertical sides of said baking pits while said floor (16) forms a bottom that is substantially horizontal.

FIG. 2 shows a typical stack of carbonaceous articles (30) in a baking pit (2, 2') surrounded by packing material (34) for a baking operation. Said packing material (34) protects said articles (30) and avoids their burning during a baking operation.

Each bay (10, 10') comprises alternately, in a transversal direction (Y axis), baking pits (2, 2') and hollow partitions (3, 3'), usually called flue walls, that are parallel to said longitudinal direction (X axis).

The hollow partitions of one bay are connected to the hollow partitions of the neighbouring bay by a first by-bass conduit (13) at one end of said bays and by a second by-pass conduit (14) at the opposite end of said bays, so as to allow the circulation of flue gas from one bay to the other one, especially when a baking sequence overlaps said two bays.

Said hollow partitions (3, 3') have a width We and, as illustrated in FIG. 2, include a first lateral wall (11) and a second lateral wall (11') that are generally separated by tie bricks (8) and baffles (9). The ends of the hollow partitions (3, 3') are usually inserted in indentations (6) provided in said transverse walls (41, 41', 42, 42', 43, 43'). Said indentations (6) are fitted with one or more apertures (7) in order to allow the gases circulating in said hollow partitions (3, 3') to pass from one section to the next. Said hollow partitions (3, 3') typically also include a headwall (12) at each end, said headwall comprising one or more apertures (7A) to allow said gases to pass from one section to the next. Said hollow partitions (3, 3') are also fitted with means of access (19) called "peepholes" which are used to introduce heating means (such as heating ramps), blowing means or exhaust means. For example, said exhaust means typically includes suction pipes (23) connected to an exhaust ramp (21) and connected to a main conduit (22) that typically runs alongside the furnace.

Said inner partitions (3, 3', 4, 4') usually include bricks that comprise interlocking means, which typically include recesses on one surface of said bricks and projections on an opposite surface of said bricks. Said projections of a brick are generally so dimensioned that they can fit in corresponding recesses of an adjacent brick so as to provide interlocking action during use in said furnace.

Said inner partitions may be so assembled that the bricks are directly in contact with each other ("dry" assembly) and/or so that an embedding material, such as grout or mortar, is placed between the bricks.

Figure 3:
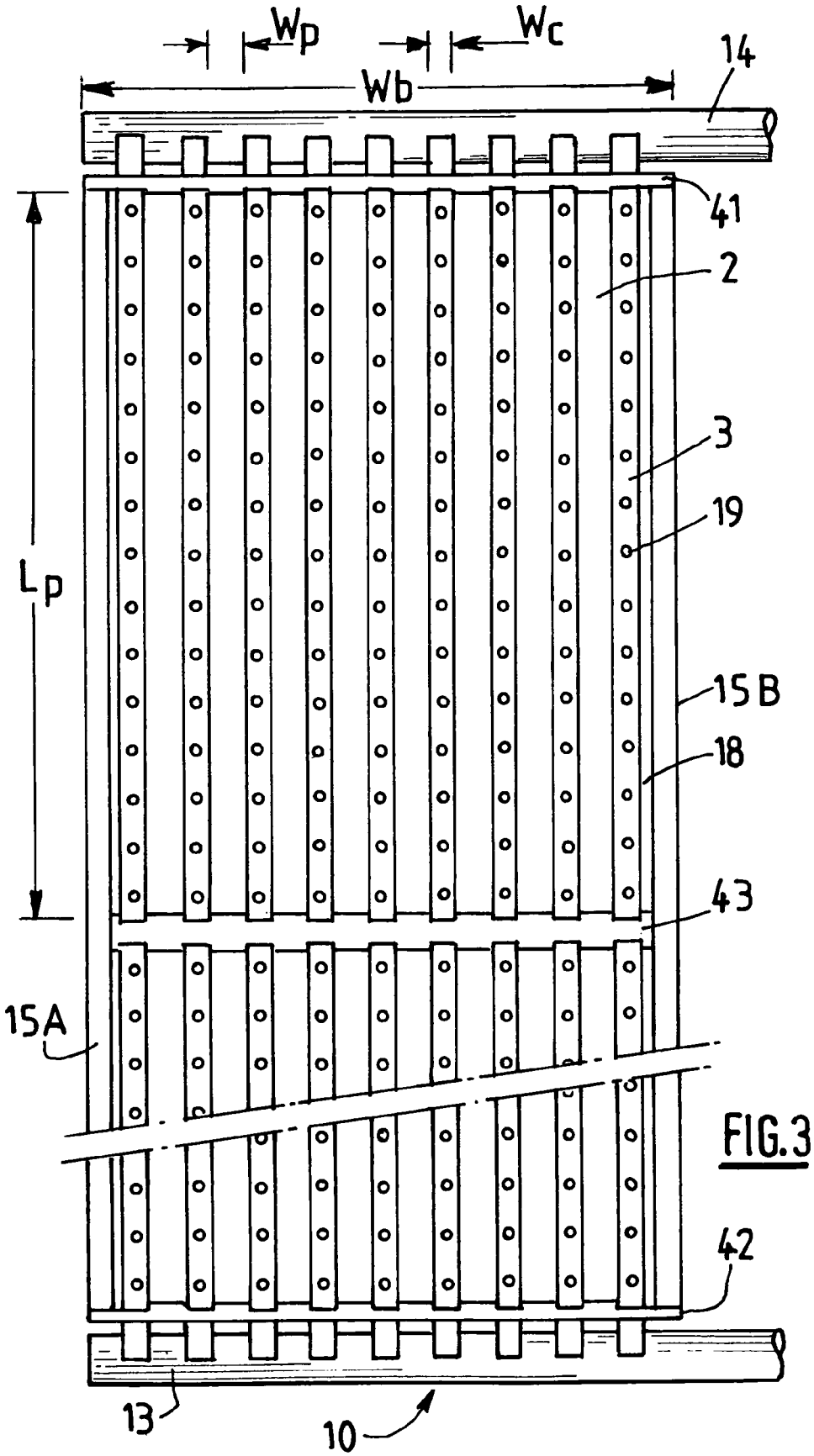
FIG. 3 illustrates a top view of a bay of an open ring furnace according to a possible embodiment of the invention.

As illustrated in FIG. 3, a ring furnace according to the invention includes baking pits (2, 2') having a large horizontal aspect ratio, and more specifically a ratio Lp/Wp that is greater than 15, i.e., said length Lp is at least 15 times greater than said width Wp. Said ratio Lp/Wp is preferably greater than 20, more preferably greater than 30, and even more preferably greater than 50.

Figure 4:
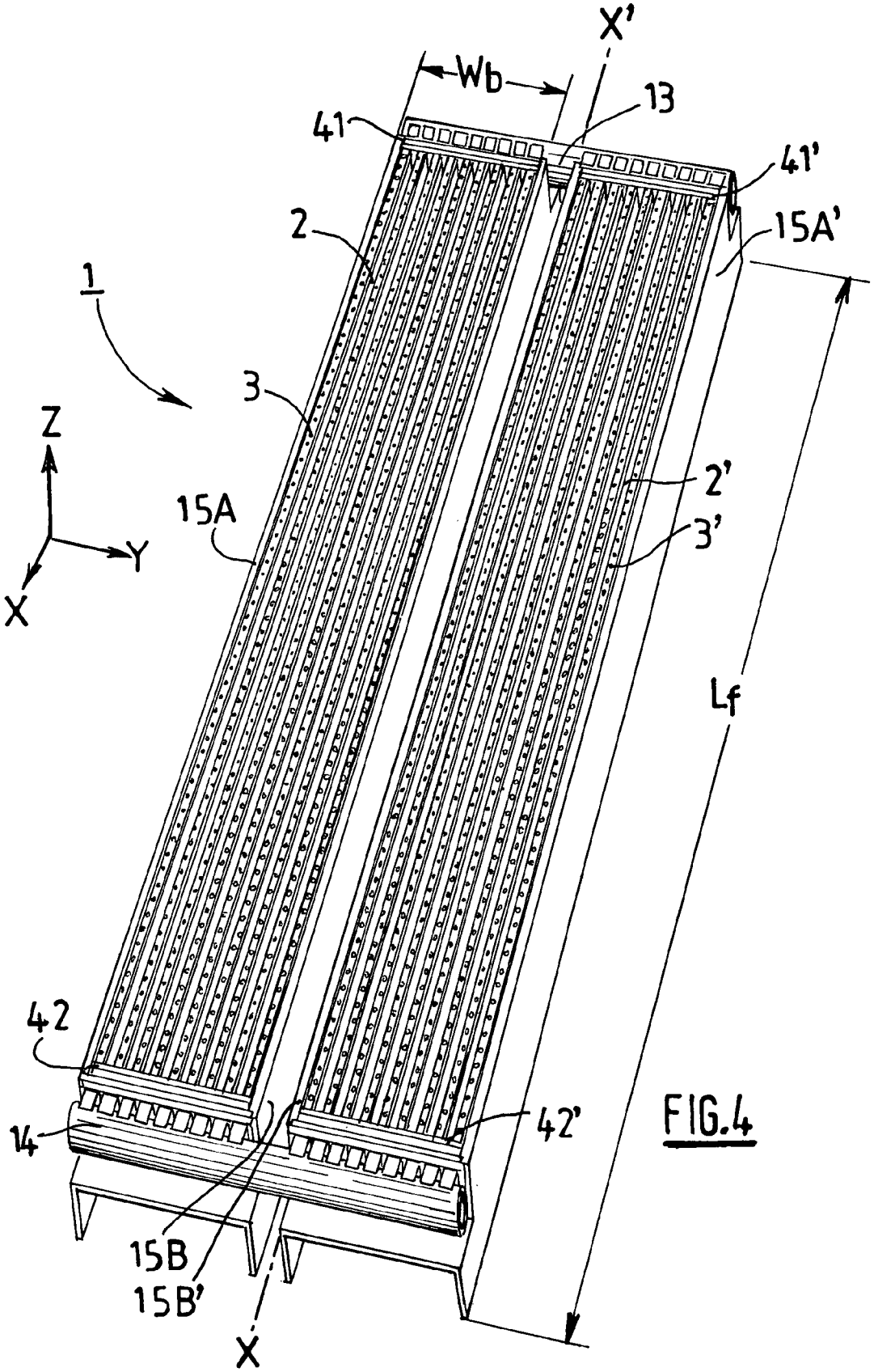
FIG. 4 illustrates a perspective view of an open ring furnace according to a possible embodiment of the invention.

A ring furnace according to the invention typically includes few or no intermediate transverse walls. In a preferred embodiment, the number of said intermediate transverse walls (43, 43') within each bay (10, 10'), if any, is smaller than or equal to 5, and more preferably smaller than or equal to 3. FIG. 4 illustrates an embodiment including no intermediate transverse wall between said first end transverse wall (41, 41') and second end transverse wall (42, 42'); in the illustrated example, the Lp/Wp ratio is equal to about 90.

Said hollow partitions (3, 3') include a plurality of refractory bricks and, preferably, further include means to allow thermal expansion of said bricks while limiting the deformation of said hollow partitions (3, 3'), such as their bowing.

For example, said hollow partitions (3, 3') may include bricks (110) comprising at least one projection (116) and at least one recess (117) that are designed to match when said bricks are assembled within said hollow partitions (3, 3'), are capable of providing interlocking action between superposed bricks and have sufficient clearance between said projection (116) and said recess (117) to allow sliding of said superposed bricks on one another over a specified distance along said longitudinal axis and, thereby, absorb their thermal expansion during use. In such an embodiment said hollow partitions (3, 3') may, at least partly, be assembled without mortar or grout, i.e. may be dry assembled. Sufficient clearance is typically from 2 to 5 mm.

Figure 5:
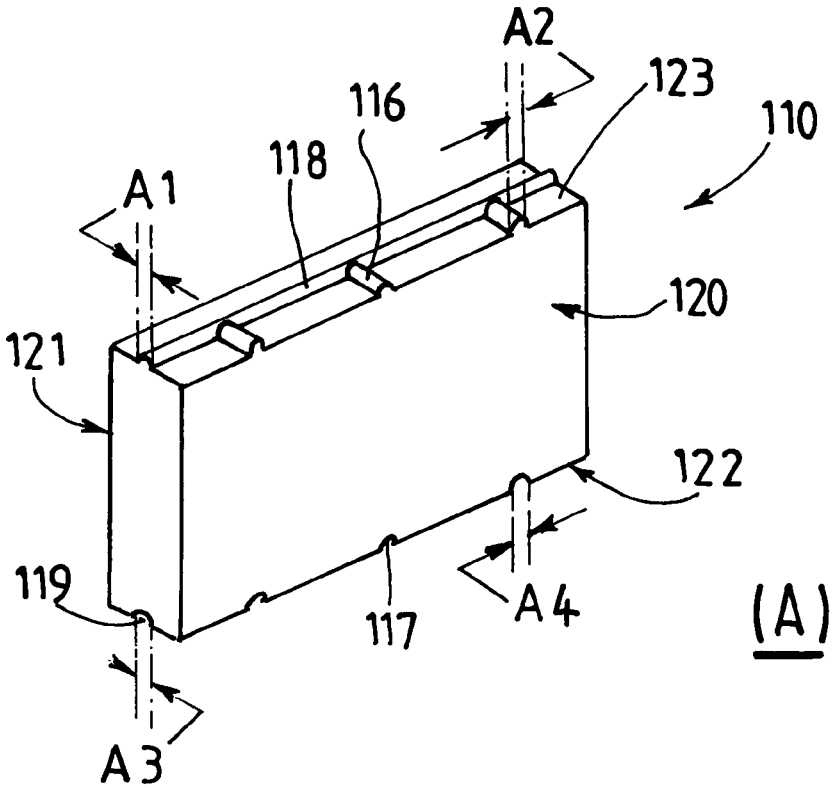
FIG. 5 illustrates a perspective view of wall bricks according to possible embodiments of the invention.
Figure 5:
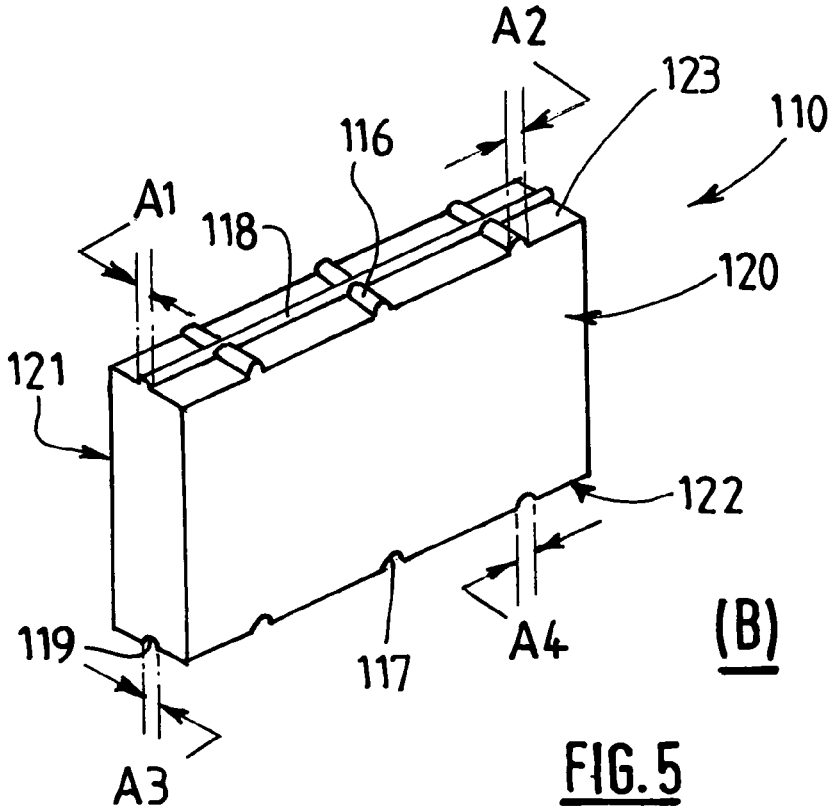

FIG. 5 illustrates possible embodiments of such bricks (110) wherein an upper surface (123) includes a longitudinal projection (118) having a first width A1 and transverse projections (116) each having a second width A2, and a lower surface (122) includes a longitudinal recess (119) having a third width A3 and transverse recesses (117) each having a fourth width A4. In the embodiment illustrated in FIG. 5(A) said brick (110) includes half-crossing transverse projections (116). In the embodiment illustrated in FIG. 5(B) said brick (110) includes full-crossing transverse projections (116). Typically, said first width A1 is substantially identical to, or slightly smaller than, third width A3 while said second width A2 is substantially smaller than said fourth width A4 so as to provide sufficient clearance to allow longitudinal displacement of said bricks caused by thermal expansion during use. In this example, surface 120 corresponds to an inner surface that is intended to be within a hollow partition (3, 3') wherein flue gas circulates while surface 121 is an outer surface that is intended to be outside said hollow partition (3, 3').

Said recesses (117, 119) are typically selected from the group consisting of grooves. Said projections (116, 118) are typically selected from the group consisting of tongues.

Alternatively, or in combination, said hollow partitions (3, 3') having lateral walls (11, 11') may include one or more expansion joints. Advantageously, said expansion joint is a built-in expansion joint comprising at least one gap between specified bricks in each said lateral wall (11, 11') and sealing bricks arranged within said hollow partition so as to overlap said gap and thereby seal the same, i.e., so as to make it substantially impervious to gas and packing material. Said gap enables thermal expansion of said lateral walls (11) while said sealing bricks limit the flow of gas and packing material (34) between the inside of said hollow partitions (3, 3') and said pits (2, 2'). Said gap typically extends over several layers of bricks, vertically.

The width Wg of said at least one gap is preferably comprised between 10 and 75 mm, and typically comprised between 40 and 60 mm.

Figure 6:
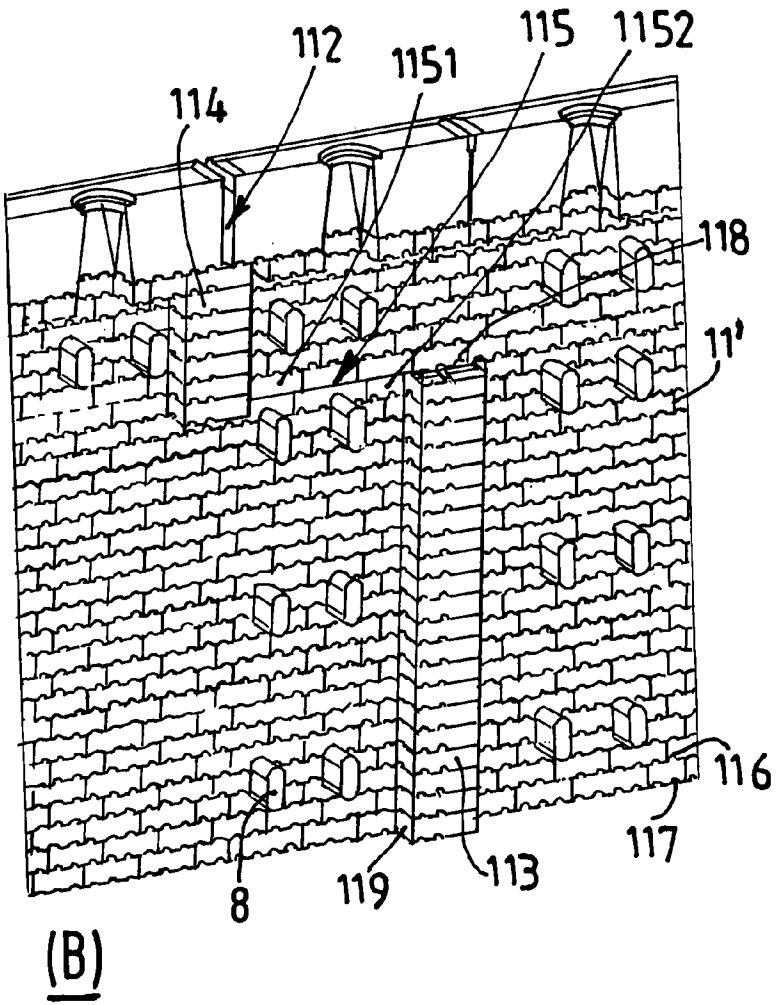
FIGS. 6 and 7 illustrate partial views of a hollow partition of an open ring furnace according to a possible embodiment of the invention.
Figure 6:
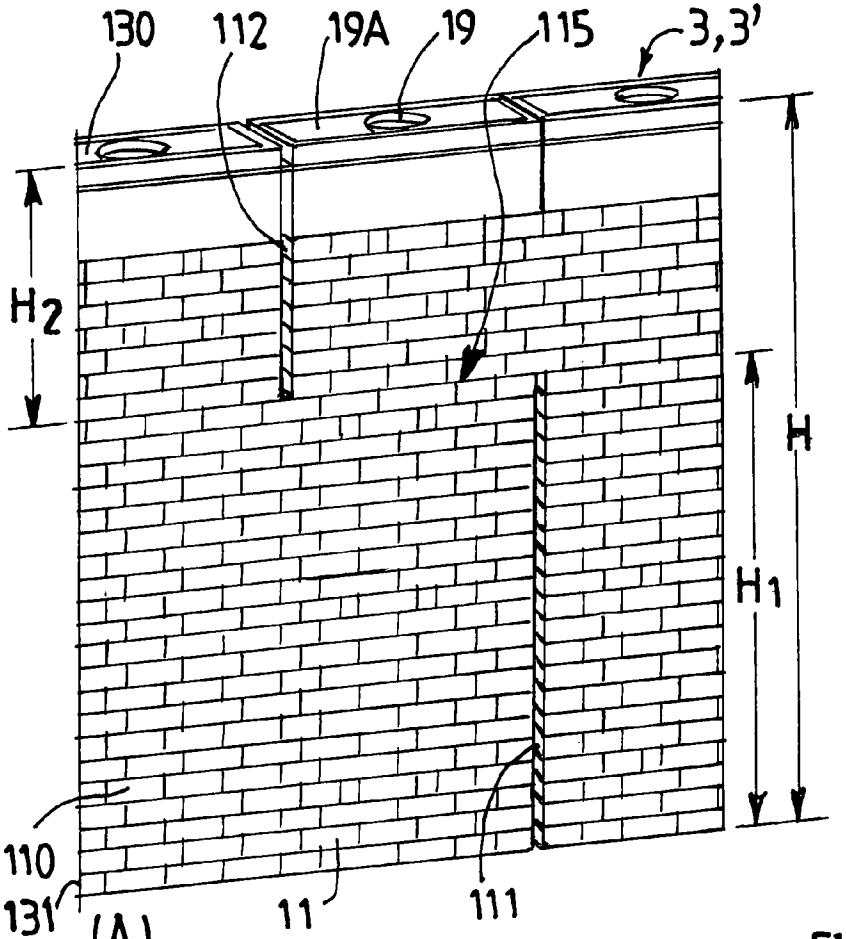
Figure 7:
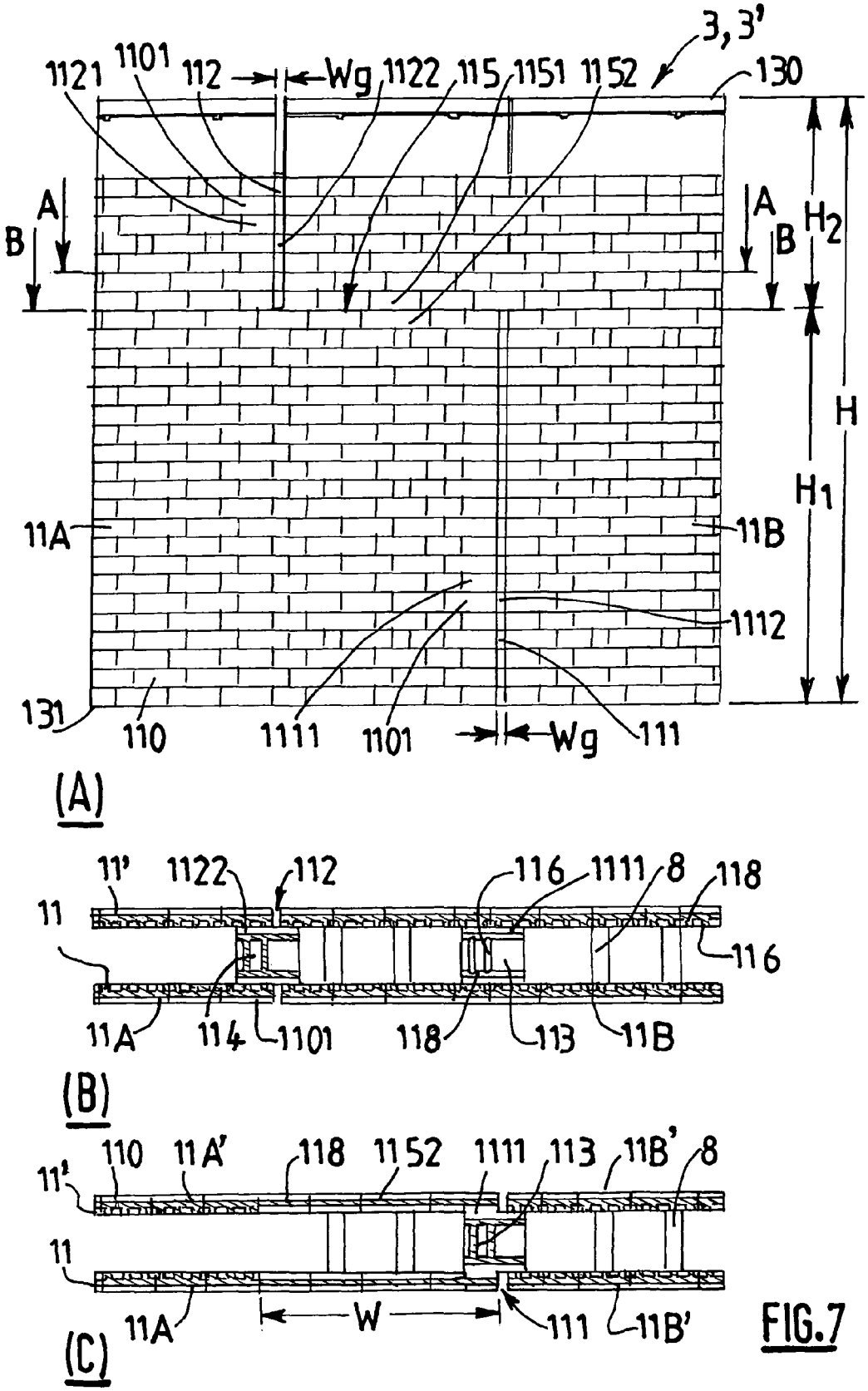

FIGS. 6 and 7 illustrate a possible embodiment of such an alternative in which a hollow partition includes one or more vertical gaps (111, 112) and pillars (113, 114) that form built-in expansion joints. Said pillars (113, 114) are formed by said sealing bricks (1111, 1112, 1121, 1122) and positioned so as to overlap said gaps (111, 112), thereby sealing the same from inside said at least one partition.

FIG. 6(A) shows a perspective view of a part of such a hollow partition. FIG. 6(B) shows a vertical, longitudinal section view of the same. FIG. 7(A) shows a side view of a part of the same. FIG. 7(B) is a horizontal cross sectional view of the same along plane A-A. FIG. 7(C) is a horizontal cross sectional view of the same along plane B-B.

Said pillars (113, 114) are typically made of at least one vertical stack of bricks that preferably includes transverse bricks (1111, 1121) that fit into the lateral walls (11, 11') of said hollow partitions (3, 3') so as to stabilize the same. Said pillars (113, 114) typically also include inner bricks (1112, 1122) that are adjacent said lateral walls (11, 11'), and more specifically adjoin wall bricks (1101). At least part of the bricks (1111, 1112, 1121, 1122) that form said pillars (113, 114) overlap said gaps (111, 112) and, preferably, snugly fit between said lateral walls (11, 111, so as to seal said gaps (111, 112) while enabling relative longitudinal displacements between said bricks and part of said lateral walls.

In this example a hollow partition has a top (130), a bottom (131) and a height H and includes at least one first vertical gap (111) running from said bottom (131) to a specified height H1, at least one second vertical gap (112) longitudinally shifted, having a length H2 and running from height H1 to said top (130), a sliding plane (115) located at height H1, between said first and second gaps, at the interface between a first horizontal row of sliding bricks (1151) and a second horizontal row of sliding bricks (1152), at least one first vertical pillar (113) running from said bottom (131) to a specified height H1, and at least one second vertical pillar (114) longitudinally shifted, having a length H2 and running from height H1 to said top (130).

Said sliding plane (115) that joins said gaps (111, 112) has width W and allows relative longitudinal displacement of a first part (11A, 11A') of said lateral walls (11, 11') that lie on one side of said gaps (111, 112) and a second part (11B, 11B') of said lateral walls (11, 11') that lie on the other side thereof longitudinally. Said sliding bricks (1151, 1152) advantageously comprise at least one longitudinal projection and/or at least one longitudinal recess on an upper or lower surface of said sliding bricks, such as the tongues (118) illustrated in FIG. 7(C), to allow relative longitudinal displacements of said sliding bricks while avoiding relative transverse displacements of the same, in order to stabilize their position transversally while allowing longitudinal sliding as a result of thermal expansion.

In this embodiment, all bricks may be assembled using mortar or grout, except within said gaps (111, 112) and sliding plane (115).

The shift between said vertical pillars (113, 114) creates a passage for flue gases and air within the partition while allowing thermal expansion.

The number of said built-in expansion joints depends on the length Lp of the baking pits. Said built-in expansion joints are typically separated by a distance comprised between 5 and 10 meters.

Said hollow partitions (3, 3') may further include tie bricks (8) and/or baffles (9) to direct the flow of flue gas.

Said hollow partitions (3, 3') typically further include upper blocks or caps (19A) that bridge said lateral walls (11, 11').

The invention also relates to a method of baking carbonaceous articles (30) including:

providing a ring furnace (1) according to the invention, stacking carbonaceous articles (30) in at least one baking pit (2, 2') of said furnace so as to form at least one stacking arrangement (31) having a length La, a first end (311, 321) and a second end (312), adding packing material (34), such as coke powder, around said stacking arrangement (31) so as to protect said articles (30) during said baking, providing at least a first heating ramp (24, 25, 26), an exhaust ramp (21), a blowing ramp (27) and, optionally, a first cooling ramp (28), and firing a specific part of said arrangement using said heating ramp (24, 25, 26).

Figure 8:
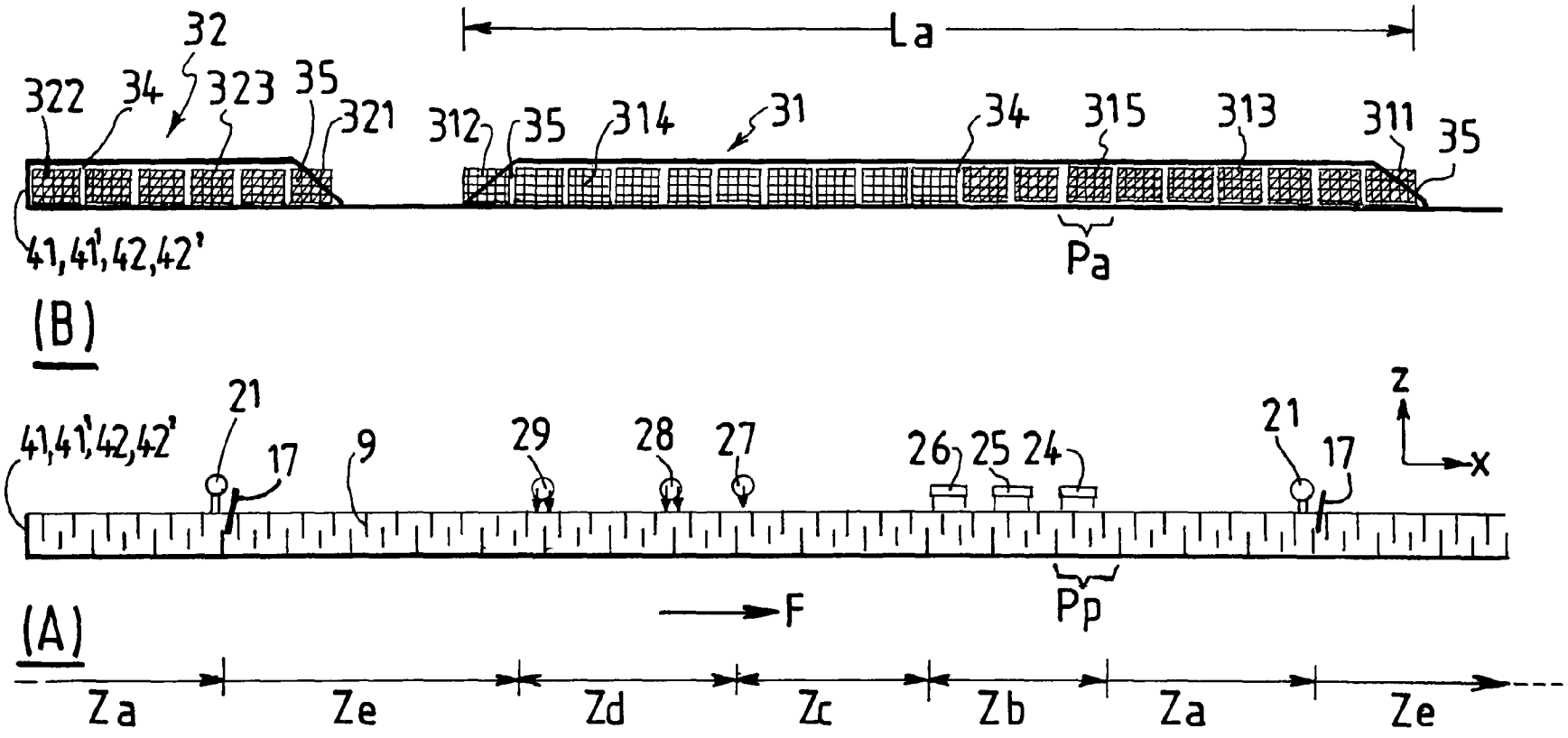
FIG. 8 illustrates a typical stacking arrangement and baking process according to a possible embodiment of the invention.

Said stacking arrangement (31) may be constituted by a train of articles stacked side-by-side or by a train of groups (315) of articles stacked side-by-side, as illustrated in FIG. 8. FIG. 8(A) provides a vertical cross-section view of a hollow partition (3, 3') according to the invention in the longitudinal X direction. FIG. 8(B) shows stacking arrangements (31, 32) of carbonaceous articles between hollow partitions according to the invention.

Said groups (315) of articles may constitute a step Pa for the loading of green articles (313, 323) or the unloading of baked articles (314). Said groups (315) of articles may contact each other or be separated by a determined distance that is preferably small compared to their length so as to optimize the yield of a furnace.

Said packing material (34) is typically added by pouring the same into the baking pits (2, 2') containing said stacking arrangement (31) so as to cover most of the top and sides thereof. Said packing material (34) typically forms embankments (35) at said ends (311, 312) of said stacking arrangement (31). Said embankments (35) preferably do not extend beyond said first end (311, 321) of said stacking arrangement (31), as illustrated in FIG. 8(B), so as to ease the loading of carbonaceous articles in operation.

Said packing material (34) is poured over substantially the entire length La of said stacking arrangement (31) when baking operations are first started. Afterwards, said packing material (34) is poured only at said first end (311) of said stacking arrangement (31) after fresh green articles have been added to said first end.

Typically, the packing material contained at said second end (312) of said stacking arrangement (31) is removed by suction before specified baked articles are removed from said furnace.

The part of said furnace that is located between said exhaust ramp (21) and said first heating ramp (24) is a pre-heating zone Za. The carbonaceous articles that are included in the part of said stacking arrangement (31) that is located within said pre-heating zone Za are normally green (i.e., are not yet baked) and are warmed up before firing during a baking process. A blanking or closing means (17) is preferably inserted within the peepholes (19) of the hollow partitions (3, 3') that are close to said exhaust ramp (21) so as to prevent the suction of air coming from a neighbouring loading/unloading zone Ze. Said blanking or closing means (17) may be, for example, a closure arrangement such as described in European Patent Application No. EP 295 192 or fine, flexible steel plates, or any equivalent arrangement and means.

The part of said furnace that is located in the vicinity of said first heating ramp (24) or, if applicable, in the vicinity of a group of heating ramps (24, 25, 26) is a firing zone Zb. The carbonaceous articles that are included in the part of said stacking arrangement (31) that is located within said firing zone Zb undergo a firing operation at elevated temperature (typically from 1100 to 1200° C.) during a baking process.

The part of said furnace that is located between said first heating ramp (24) or, if applicable, between said group of heating ramps (24, 25, 26) and said blowing ramp (27) is a first cooling zone Zc. The carbonaceous articles that are included in the part of said stacking arrangement (31) that is located within said first cooling zone Zc are normally baked and are cooled down after firing during a baking process. The peepholes (19) that are located in said first cooling zone Zc are preferably closed so as to direct the flow of cooling air towards said firing zone Zb and favour its being warmed up before reaching the same.

One or more cooling ramps (28, 29) may be used during a baking process in order to further cool the carbonaceous articles after a first cooling-down phase in said first cooling zone Zc. In such a case, the part of said furnace that is located between said first blowing ramp (27) and up to the last cooling ramp (28, 29) is a second cooling zone Zd. The peepholes (19) that are located in said second cooling zone Zd are preferably open so as to favour rapid cooling of the same.

The part of said furnace that extends beyond said cooling zones Zc, Zd includes a loading/unloading zone Ze.

Said pre-heating zone Za, said firing zone Zb, said first cooling zone Zc and, when applicable, said second cooling zone Zd are called active zones and make up a full baking sequence.

As illustrated in FIG. 8, said stacking arrangement (31) normally extends over all active zones of a baking sequence. Green articles (313, 323) are added to said stacking arrangement (31) and baked articles (314) are removed from said furnace in said loading/unloading zone Ze. When a baking sequence is set up, all articles of a stacking arrangement (31) are green. When a baking sequence is in progress, a stacking arrangement (31) includes green articles (313, 323) from its first end (311) inwards and baked articles (314) from its second end (312) inwards. The transition from green articles (313, 323) to baked articles (314) takes place within the firing zone Zb.

Said stacking arrangement (31) may be fully included within a single pit (2, 2') or spread over one or more pits (2, 2') by overlapping one or more transverse walls. Said stacking arrangement (31) may also be split into two parts, initially or as a baking sequence creeps along said bays (10, 10'), so that one part is located in one bay while the other part is in another bay and so that one end of each part abuts against an end transverse walls (41, 41', 42, 42'), as illustrated in FIG. 8 (where an end (322) of a part of a stacking arrangement (32) abuts an end transverse wall (41, 41', 42, 42')); in such cases, a baking process overlaps two neighbouring bays.

Said first end (311, 321) and second end (312) of said stacking arrangement (31) are often remote from transverse walls, whether they be end transverse walls (41, 41', 42, 42') or intermediate transverse walls (43, 43'), although they eventually reach and pass said transverse walls as said baking sequence is shifted along said bays (10, 10').

A ring furnace may include more than one baking sequence, as illustrated in FIG. 8, which shows a first baking sequence relating to a first stacking arrangement (31) and part of a second baking sequence relating to a second stacking arrangement (32).

For a baking operation, each of said ramps (21, 24, 25, 26, 27, 28, 29) is fitted to said hollow partitions (3, 3') using said peepholes (19). During a baking process, once a firing operation is deemed to be terminated, said active zones (Za, Zb, Zc, Zd), as well as the loading/unloading zone Ze, are moved in the direction of arrow F in FIG. 8. For that purpose, said ramps (21, 24, 25, 26, 27, 28, 29) are shifted towards the green carbonaceous articles by a specified distance Pp called "step". When said baking process is in progress, baked articles are removed at said second end (312) of said stacking arrangement (31) and green articles are added at said first end (311) of said stacking arrangement (31).

The removal of baked articles at said second end (312) and the addition of green articles at said first end (311) and the shifting of said ramps may be performed separately and according to different sequences so long as the global rates match and ensure an identical average creeping pace for both.

During baking operations, a gaseous flow containing air, heating gas, vapours given off by the carbonaceous articles or combustion gases (or, most often, a mixture of them) circulates, in the longitudinal direction of the furnace (X axis), in said hollow partitions (3, 3'). Said gaseous flow is blown upstream of said active zones and is sucked downstream thereof. The heat produced by the combustion of the gases is transmitted to said carbonaceous articles (30) contained in the baking pits (2, 2'), which leads to their firing.

Said exhaust ramp (21) provides suction through the peepholes (19) where it is fitted. For that purpose, said exhaust ramp (21) are typically fitted to suction means, such as fans, located downstream thereof.

Said heating ramp or ramps (24, 25, 26) include burners capable of producing one or more flames within said hollow partitions (3, 3') so as to provide heat at least in the vicinity of said firing zone Zb.

Said blowing and cooling ramps (27, 28, 29) provide the input of air, typically cool air, within said hollow partitions (3, 3'), using blowers that are fitted thereto.

For a baking process, said exhaust ramp (21), said blowing ramp (27) and, if applicable, said cooling ramp or ramps (28, 29) are activated so as to produce a specific gaseous flow within said hollow partitions (3, 3') and said burners of said heating ramp or ramps (24, 25, 26) are lit so as to produce said heat within said hollow partitions (3, 3').

In a preferred embodiment of the invention, said method of baking further includes:

providing at least one removable strut (50) comprising a support member (54), such as a bar, and at least one spacer (51), and positioning said removable strut (50) so that said spacer (51) is inserted in one of said baking pits (2, 2').

Said removable strut (50) is typically positioned in a zone of said baking pits (2, 2') that contains no carbonaceous article (30) or optionally positioned in a zone of said baking pits (2, 2') that contains carbonaceous article (30) without packing material (34). In the former variation the height $H_T$ of said spacer (51) is typically comprised between 1 and 2 meters. In the latter variation the height $H_T$ of said spacer (51) is typically comprised between 30 cm and 60 cm.

Figure 9:
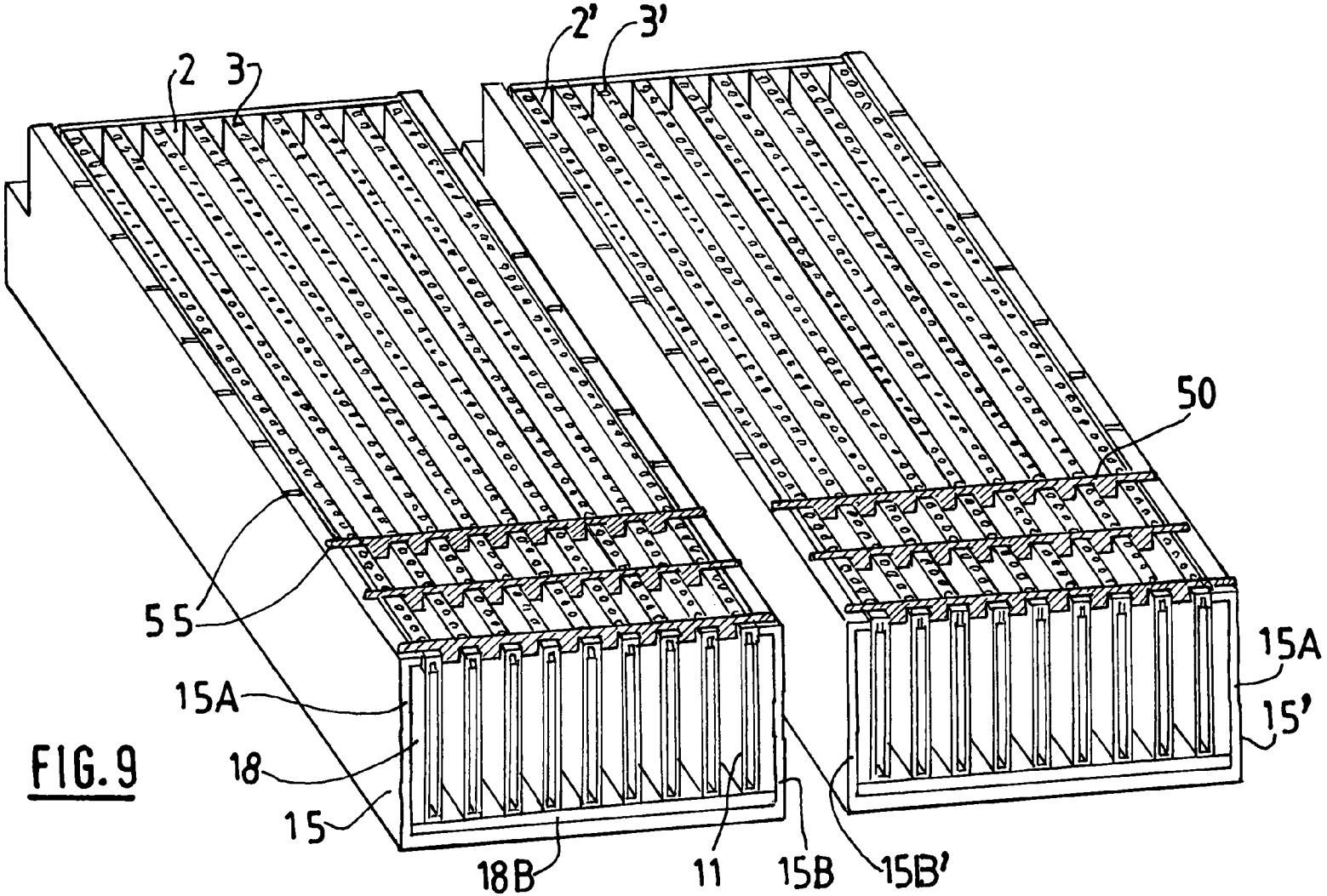
FIG. 9 illustrates a ring furnace and removable struts according to a possible embodiment of the invention.

FIG. 9 illustrates a possible positioning of removable struts (50) according to the invention.

Figure 10:
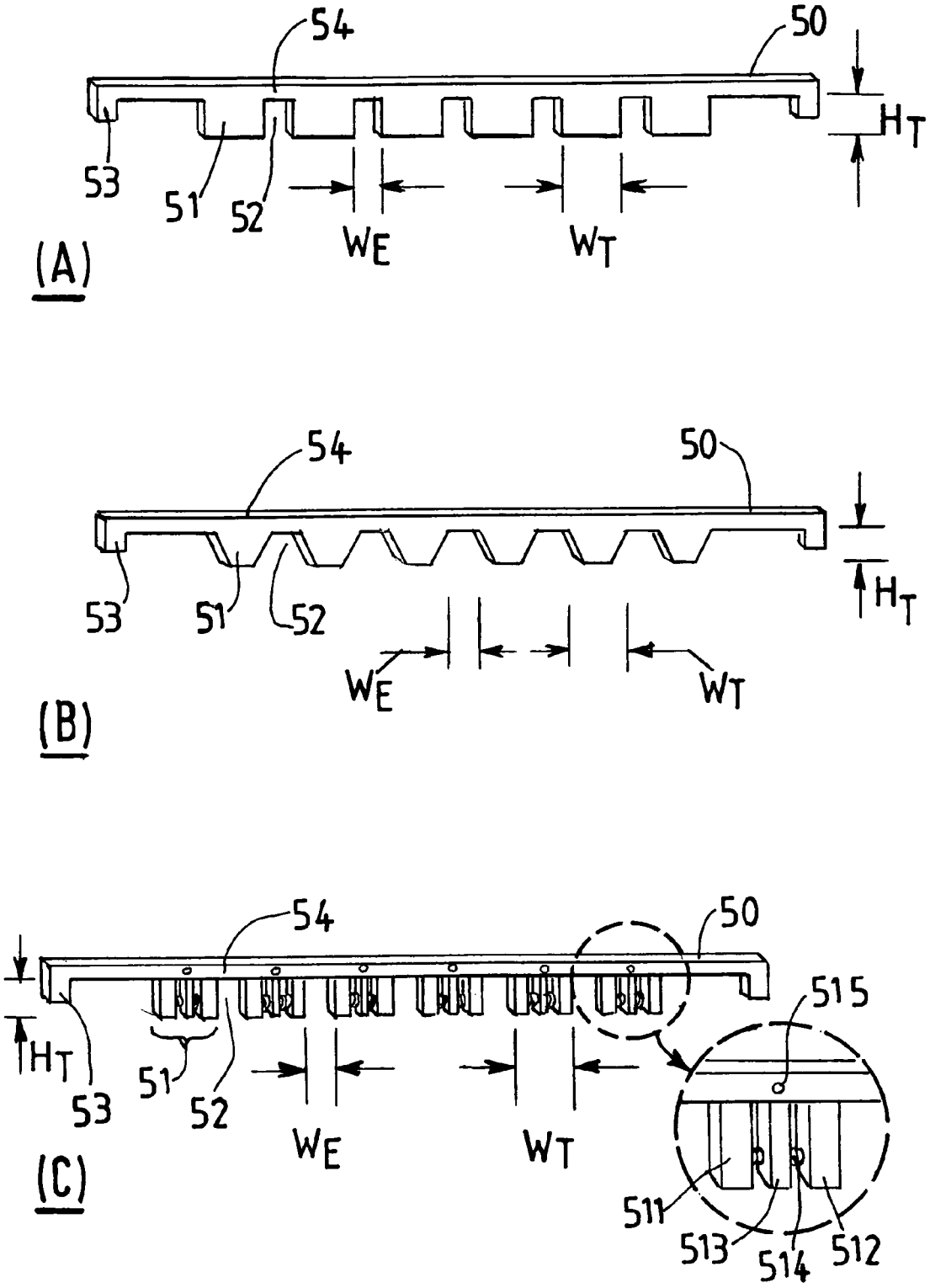
FIG. 10 illustrates removable struts according to possible embodiments of the invention and a use thereof.

As illustrated in FIG. 10, said removable strut (50) preferably comprises a plurality of spacers (51) distributed on said support member (54) so that said spacers can be inserted in adjacent baking pits (2, 2'), and preferably all adjacent baking pits of a section.

Said spacer or spacers (51) of said removable strut (50) are typically secured to a support member (54) that is sufficiently long to span the whole width Wb of a bay (10, 10') and bear on said external lateral partitions (15A, 15A', 15B, 15B') of a casing (15, 15'). The width $W_T$ of each spacer (51) is substantially equal to the width Wp of the baking pits. The spacers (51) form crenels (52) having a width $W_E$. Advantageously, said removable strut (50) further comprises a pin (53) at each end that can fit in cavities (55) provided in the casing (15, 15'), so as to limit the displacement of the strut during use.

In a simple embodiment of the invention, such as the ones illustrated in FIGS. 10(A) and 10(B), said spacers (51) are secured to said removable strut (50) so as to be in a permanent position. Said spacers (51) may be integral with said support member (54).

Said spacer or spacers (51) of said removable strut (50) are fit to be inserted in one of said baking pits (2, 2'). The width $W_T$ of said spacers (51) may be uniform, as illustrated in FIG. 10(A), or have a shaped profile (such as a trapezoidal shape), as illustrated in FIG. 10(B). The latter embodiment makes it possible to use the same strut for furnaces of a plant whose baking pit width Wp is not the same.

In an alternative embodiment of the invention, such as the one illustrated in FIG. 10(C), said removable strut (50) may include means (514) for adjusting the width $W_T$ of said spacers (51) and, consequently, the width $W_E$ of said crenels (52). For example, each spacer (51) may include a fixed arm (513), a first mobile part (511), a second mobile part (512) and one or more screws (514), which may typically be endless screws. Jacks may be provided on said removable strut (50) to enable adjustment of the width of the spacers (51). Said mobile parts (511, 512) preferably fit in a groove or the like in said support member (54). Said fixed arm (513) may be adjustably secured by bolts or the like (515) so as to make it possible to vary the position of said spacers (51).

LIST OF REFERENCE NUMERALS

1 Ring furnace
2, 2' Baking pit
3, 3' Hollow partition (flue wall)
4, 4' Transverse wall
5 Pillar
6 Indentation
7 Aperture in transverse wall
7A Aperture in headwall
8 Tie brick
9 Baffle
10, 10' Bays
11, 11' Lateral wall of a hollow partition
11A, 11A', 11B, 11B' Part of lateral wall
12 Headwall
13, 14 By-pass conduit
15, 15' Casing
15A, 15A', 15B, 15B' External lateral partition of casing
16 Floor of a baking pit
17 Blanking or closing means
18 Side refractory lining
18B Bottom refractory lining
19 Peephole
19A Upper blocks or caps of hollow partition
21 Exhaust ramp
22 Main conduit
23 Suction pipe
24, 25, 26 Heating ramp
27 Blowing ramp
28, 29 Cooling ramp
30 Carbonaceous article
31, 32 Stacking arrangement
34 Packing material
35 Embankment
41, 41' First end transverse wall
42, 42' Second end transverse wall
43, 43' Intermediate transverse wall
50 Strut
51 Spacer
52 Crenel
53 Pin
54 Support member
55 Cavity
110 Refractory bricks
111 Gap
112 Gap
113 Pillar
114 Pillar
115 Sliding plane
116 Transverse projection
117 Transverse recess
118 Longitudinal projection
119 Longitudinal recess
120 Inner surface
121 Outer surface
122 Lower surface
123 Upper surface
130 Top of hollow partition
131 Bottom of hollow partition
311, 321 First end of stacking arrangement
312 Second end of stacking arrangement
313, 323 Green articles
314 Baked articles
315 Group of articles
322 Abutting end
511 Mobile part
512 Mobile part
513 Arm
514 Adjustment means
1101 Wall brick
1111 Transverse sealing brick
1112 Inner sealing brick
1121 Transverse sealing brick
1122 Inner sealing brick
1151 Upper sliding brick
1152 Lower sliding brick

The invention claimed is:

1. Ring furnace having a longitudinal axis and comprising a first elongated bay and a second elongated bay, each bay being parallel to said axis and including a casing, a plurality of hollow partitions arranged within said casing of each bay so as to be parallel to said axis, and a plurality of transverse walls including a first end transverse wall located at a first end of each bay, a second end transverse wall located at a second end of each bay, and possibly one or more intermediate transverse walls located between said first and second ends, said transverse walls being arranged so as to be perpendicular to said axis, said hollow partitions and said transverse walls defining baking pits within said bays for stacking carbonaceous articles therein, said baking pits having a length measured parallel to said axis and a width measured transverse to said axis, said length being at least 15 times greater than said width, wherein said hollow partitions have lateral walls and include a built-in expansion joint comprising at least one gap between specified bricks in each said lateral wall and sealing bricks arranged within said hollow partition so as to overlap said gap and thereby seal the same.

2. Ring furnace according to claim 1, wherein said length is at least 20 times greater than said width.

3. Ring furnace according to claim 1, wherein the ring furnace comprises a number of the intermediate transverse walls within each bay, wherein the number of intermediate transverse walls is smaller than or equal to 5.

4. Ring furnace according to claim 1, wherein the ring furnace comprises a number of the intermediate transverse walls within each bay, wherein the number of intermediate transverse walls is smaller than or equal to 3.

5. Ring furnace according to claim 1, wherein no intermediate transverse walls are located between said first end transverse wall and second end transverse wall.

6. Ring furnace according to claim 1, wherein said hollow partitions include a plurality of bricks and means to allow thermal expansion of said bricks while limiting deformation of said hollow partitions.

7. Ring furnace according to claim 6, wherein said hollow partitions include bricks comprising at least one projection and at least one recess that are designed to match when said bricks are assembled within said hollow partitions, are capable of providing interlocking action between superposed bricks and have sufficient clearance between said projection and said recess to allow sliding of said superposed bricks on one another over a specified distance along said longitudinal axis and, thus, absorb their thermal expansion during use.

8. Ring furnace according to claim 7, wherein said sufficient clearance is from 2 to 5 mm.

9. Ring furnace according to claim 6, wherein said hollow partitions include one or more expansion joints.

10. Ring furnace according to claim 1, wherein said at least one gap is vertical and wherein said sealing bricks form at least one pillar that is positioned so as to overlap said gap, thereby sealing said gap from inside said at least one hollow partition.

11. Ring furnace according to claim 10, wherein said at least one pillar is made of at least one vertical stack of bricks that includes transverse bricks that fit into said lateral walls of said at least one hollow partition so as to stabilize the same.

12. Ring furnace according to claim 10, wherein said at least one hollow partition has a top, a bottom and a height and includes at least one first vertical gap running from said bottom to a specified height, at least one second vertical gap longitudinally shifted, having a gap length and running from said specified height to said top, a sliding plane located at said specified height, between said first and second gaps, at the interface between a first horizontal row of sliding bricks and a second horizontal row of sliding bricks, at least one first vertical pillar running from said bottom to said specified height, and at least one second vertical pillar longitudinally shifted, having a pillar length and running from said specified height to said top.

13. Ring furnace according to claim 12, wherein said sliding plane allows relative longitudinal displacement of a first part of said lateral walls that lie on one side of said gaps and a second part of said lateral walls that lie on the other side thereof longitudinally.

14. Method of baking carbonaceous articles including:

providing a ring furnace having a longitudinal axis and comprising a first elongated bay and a second elongated bay, each bay being parallel to said axis and including a casing, a plurality of hollow partitions arranged within said casing of each bay so as to be parallel to said axis, and a plurality of transverse walls including a first end transverse wall located at a first end of each bay, a second end transverse wall located at a second end of each bay, and possibly one or more intermediate transverse walls located between said first and second ends, said transverse walls being arranged so as to be perpendicular to said axis, said hollow partitions and said transverse walls defining baking pits within said bays for stacking carbonaceous articles therein, said baking pits having a length measured parallel to said axis and a width measured transverse to said axis, said length being at least 15 times greater than said width, stacking carbonaceous articles in at least one baking pit of said furnace so as to form at least one stacking arrangement having an arrangement length, a first end and a second end, adding packing material around said stacking arrangement so as to protect said articles during said baking, providing at least a first heating ramp, an exhaust ramp, a blowing ramp and, optionally, a first cooling ramp, firing a specific part of said arrangement using said heating ramp;

providing at least one removable strut comprising a support member and at least one spacer; and positioning said removable strut so that said spacer is inserted in one of said baking pits.

15. Method of baking carbonaceous articles according to claim 14, wherein said packing material forms embankments at said first end and second end of said stacking arrangement and wherein said embankments do not extend beyond said first end of said stacking arrangement.

16. Method of baking carbonaceous articles according to claim 14, wherein baked articles are removed at said second end of said stacking arrangement and green articles are added at said first end of said stacking arrangement.

17. Method of baking carbonaceous articles according to claim 14, wherein said removable strut is positioned in a zone of said baking pits that contains no carbonaceous article or in a zone of said baking pits that contains carbonaceous article without packing material.

18. Method of baking carbonaceous articles according to claim 14, wherein said removable strut comprises a plurality of spacers distributed on said support member so that said spacers can be inserted in adjacent baking pits.

19. Method of baking carbonaceous articles according to claim 14, wherein said casing has external lateral partitions and wherein said spacers of said removable strut are secured to a support member that is sufficiently long to span the whole width of a bay and bear on said external lateral partitions.

20. Method of baking carbonaceous articles according to claim 14, wherein said spacers have a spacer width that is uniform.

21. Method of baking carbonaceous articles according to claim 14, wherein said spacers have a spacer width that has a shaped profile.

22. Method of baking carbonaceous articles according to claim 14, wherein said spacers have a spacer width and said removable strut has means to adjust said spacer width.

23. Method of baking carbonaceous articles according to claim 22, wherein said means to adjust said spacer width includes at least one jack provided on said removable strut.

24. Method of baking carbonaceous articles according to claim 14, wherein said carbonaceous articles are carbonaceous anodes designed for use in electrolysis cells intended for the production of aluminium through the Hall-Heroult process.

* * * * *